US011626125B2

(12) United States Patent
Zhang et al.

(10) Patent No.: US 11,626,125 B2
(45) **Date of Patent: *Apr. 11, 2023**

(54) SYSTEM AND APPARATUS FOR REAL-TIME SPEECH ENHANCEMENT IN NOISY ENVIRONMENTS

(71) Applicant: Board of Trustees of Michigan State University, East Lansing, MI (US)

(72) Inventors: Mi Zhang, Okemos, MI (US); Kai Cao, East Lansing, MI (US); Xiao Zeng, Lansing, MI (US); Haochen Sun, East Lansing, MI (US)

(73) Assignee: BOARD OF TRUSTEES OF MICHIGAN STATE UNIVERSITY, East Lansing, MI (US)

( * ) Notice: Subject to any disclaimer, the term of this patent is extended or adjusted under 35 U.S.C. 154(b) by 215 days.

This patent is subject to a terminal disclaimer.

(21) Appl. No.: 17/074,365

(22) Filed: Oct. 19, 2020

(65) Prior Publication Data

US 2021/0050030 A1 Feb. 18, 2021

Related U.S. Application Data

(63) Continuation of application No. 16/129,467, filed on Sep. 12, 2018, now Pat. No. 10,811,030.
(Continued)

(51) Int. Cl.
*G10L 21/00* (2013.01)
*G10L 21/0264* (2013.01)
(Continued)

(52) U.S. Cl.
CPC ..... *G10L 21/0264* (2013.01); *G10K 11/175* (2013.01); *G10L 21/0232* (2013.01);
(Continued)

(58) Field of Classification Search
None
See application file for complete search history.

(56) References Cited

U.S. PATENT DOCUMENTS 8,015,003 B2 * 9/2011 Wilson ..... G10L 21/0208 704/226
8,874,441 B2 * 10/2014 Zhang ..... G10L 21/0208 704/226
(Continued)

FOREIGN PATENT DOCUMENTS

EP 3007467 4/2016

*Primary Examiner* — Satwant K Singh
(74) *Attorney, Agent, or Firm* — Quarles & Brady LLP

(57) ABSTRACT

A system may perform speech enhancement of audio data in real-time by suppressing noise components that are present in the audio data while preserving speech components. The system may include an in-ear module and a separate signal processing module that is wirelessly communicatively coupled to the in-ear module. The system may include non-negative matrix factorization (NMF) dictionaries capable of identifying frequency band components associated with speech and frequency band components associated with noise. The NMF dictionaries may be trained using voice samples and noise samples. The NMF dictionaries may be applied to noisy speech data to produce an NMF representation of the speech data which may then be applied using a dynamic mask to the noisy speech data in order to suppress the noise components of the noisy speech data and produce speech enhanced data.

26 Claims, 4 Drawing Sheets

Related U.S. Application Data

(60) Provisional application No. 62/557,563, filed on Sep. 12, 2017.

(51) Int. Cl.

| | |
|---|---|
| ***G10K 11/175*** | (2006.01) |
| ***G10L 21/0232*** | (2013.01) |
| ***G10L 25/03*** | (2013.01) |
| *G10L 21/0272* | (2013.01) |

(52) U.S. Cl.
CPC ..... *G10L 25/03* (2013.01); *G10K 11/1752* (2020.05); *G10L 21/0272* (2013.01)

(56) References Cited

U.S. PATENT DOCUMENTS

| | | | | |
|---|---|---|---|---|
| 9,437,208 | B2 | 9/2016 | Sun | |
| 9,553,681 | B2 | 1/2017 | Hoffman | |
| 9,679,559 | B2 * | 6/2017 | Le Roux | G10L 15/20 |
| 9,721,202 | B2 * | 8/2017 | Boulanger-Lewandowski | G06N 3/0445 |
| 9,734,842 | B2 * | 8/2017 | Le Magoarou | G10L 21/0232 |
| 10,013,975 | B2 * | 7/2018 | Guo | G10L 21/028 |
| 10,276,179 | B2 * | 4/2019 | Tashev | G06F 40/242 |
| 10,811,030 | B2 * | 10/2020 | Zhang | G10L 21/0232 |
| 2016/0071526 | A1 * | 3/2016 | Wingate | G01S 3/807 704/233 |
| 2016/0247518 | A1 | 8/2016 | Schuller | |
| 2017/0178664 | A1 | 6/2017 | Wingate | |

* cited by examiner

SYSTEM AND APPARATUS FOR REAL-TIME SPEECH ENHANCEMENT IN NOISY ENVIRONMENTS

CROSS REFERENCE TO RELATED APPLICATIONS

This application is a continuation of U.S. patent application Ser. No. 16/129,467, filed Sep. 12, 2018, which claims priority to U.S. Provisional Application No. 62/557,563, filed Sep. 12, 2017, the entire content of each is incorporated herein by reference.

STATEMENT REGARDING FEDERALLY SPONSORED RESEARCH

This invention was made with government support under 1565604 awarded by the National Science Foundation. The government has certain rights in the invention.

BACKGROUND

There are approximately 30 million individuals in the United States that have some appreciable degree of hearing loss that impacts their ability to hear and understand others. And, this segment of the population is especially impacted when attempting to listen to the speech of others in an environment in which background noise and intermittent peaks in noise are present, making it difficult to follow a conversation.

A certain category or categories of technologies (e.g., hearing aids and assistive listening devices) exist which are directed to enhancing an individual's ability to hear. However, there are multiple situations in which these technologies do not perform optimally. For example, in noisy environments (e.g., environments in which background noise or other noise is present) it may be difficult for a hearing impaired or hard of hearing individual to distinguish the speech of a person with whom they are having a conversation from the noise. Even when a traditional hearing assistance device, such as a hearing aid, is used, such technology may amplify sound indiscriminately, providing as much amplification of noise as is provided for the speech of individuals engaged in conversation.

Other attempts to isolate and improve the ability to hear voices in the presence of background noise have also proven insufficient to help hearing impaired individuals understand conversations in real time as the conversations are occurring. For example, some software solutions exist that can enhance speech by separating audio sources from mixed audio signals. However, those algorithms can only isolate the speech in an offline, after-the-fact manner, using the whole audio recording. This is, of course, not helpful to an individual trying to understand a current, on-going, live conversation with another person.

In light of the above, there remains a need for improved methods of operation for assistive hearing technologies.

SUMMARY

The present disclosure generally relates to audio signal enhancement technology. More specifically, the present disclosure encompasses systems and methods that provide a complete, real-time solution for identifying an audio source (e.g. speech) of interest from a noisy incoming sound signal (either ambient or electronic) and improving the ability of a user to hear and understand the speech by distinguishing the speech in volume or sound quality from background noise. In one embodiment, these systems and methods may utilize a deep learning approach to identify parameters of both speech of interest and background noise, and may utilize a Non-negative Matrix Factorization (NMF) based approach for real-time enhancement of the sound signal the user hears.

BRIEF DESCRIPTION OF THE DRAWINGS

The present invention will hereafter be described with reference to the accompanying drawings, wherein like reference numerals denote like elements.

DETAILED DESCRIPTION

Figure 1:
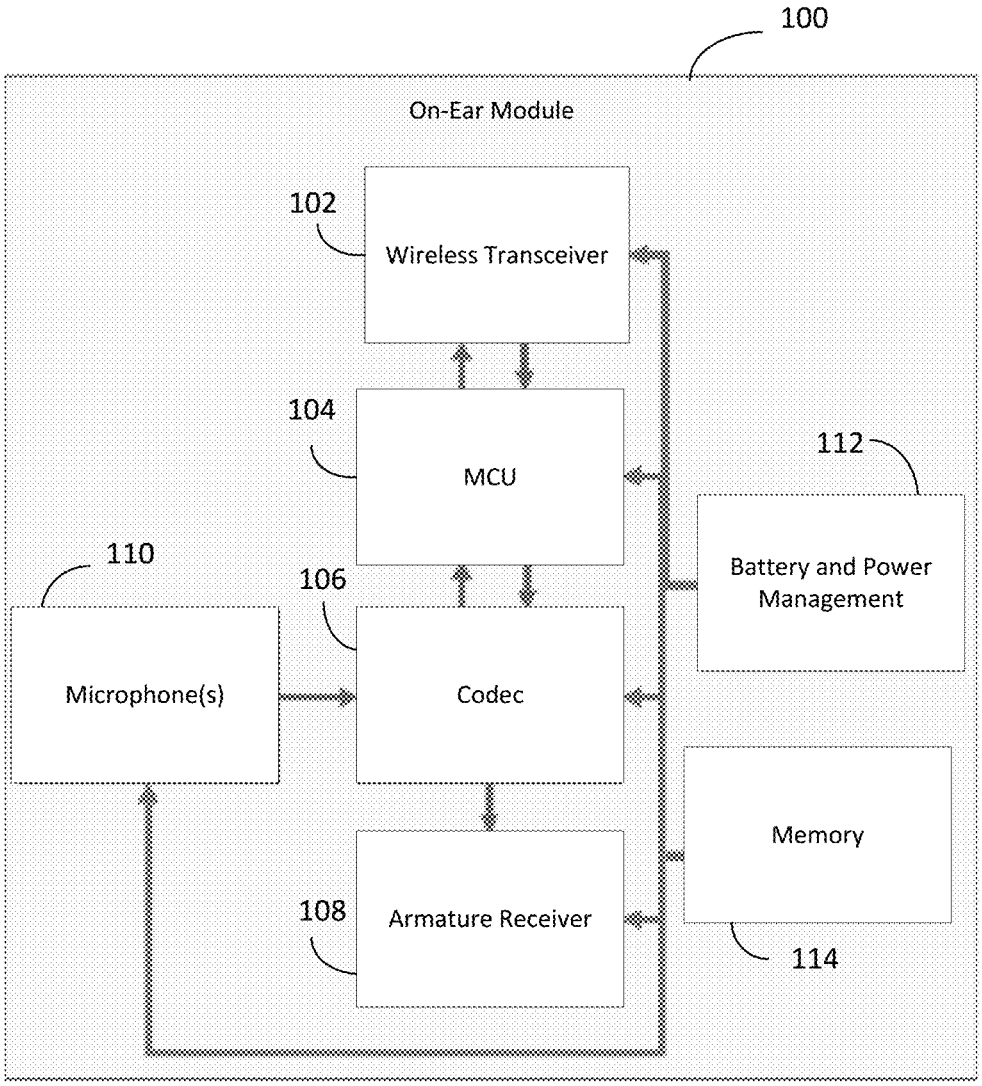
FIG. 1 is a schematic diagram of an illustrative on-ear module, in accordance with aspects of the present disclosure.

In order to suppress (e.g., remove or reduce volume of) background noise or other unwanted sounds (e.g., background sounds of others' talking, sirens, music, dogs barking, or the background hum, echo, or murmur of a room full of others speaking) from a signal containing an audio source (e.g. speech or other sounds of interest such as heart murmurs, emergency alerts, or other hard-to-distinguish sounds) of interest, the inventors have discovered that it may be helpful to identify the components of the noisy speech signals corresponding to noise (the unwanted portion of the signal) as well as the components of the noisy speech signals corresponding to the speech of interest. In one respect, identification of noise can be an independent step from identification of the audio source of interest. Unwanted background sounds may also effectively be suppressed by increasing the volume of speech of interest without increasing the volume of the unwanted background sounds. Machine learning techniques may be utilized to accomplish this task.

For example, a non-negative matrix factorization (NMF) dictionary may be trained using many (e.g., thousands or tens of thousands of) pure speech samples and pure noise samples in order to identify frequency ranges across which speech and noise may occur. NMF is a technique in linear algebra that decomposes a non-negative matrix into two non-negative matrices. In various systems and techniques discussed herein, this function is applied as a component of the machine learning framework described below for noise removal and speech enhancement. While various machine learning approaches could be used in concert with NMF in the systems and methods discussed herein, a 'Sparse Learning' or 'Dictionary Learning' a machine learning approach will be described in reference to several exemplary embodiment. These machine learning techniques may be used (via a training process) to find the optimal or precise representations of clear audio signals of interest as well as to find optimal or precise representations of background or unwanted noise in an audio signal.

For example, in Dictionary Learning, to find the best representation for audio signals of interest and 'noise' audio signals, techniques described herein may first find the proper representation basis (dictionary) for each. The proper representation basis (dictionary) is obtained by 'training' a Dictionary Learning model on a set of training data. More specifically, a training process may involve iteratively using an NMF technique to decompose noisy speech data into audio signal representations and include them in a dictionary. Using machine learning techniques such as these allows for various modifications or enhancements (described below) to an input audio signal to reduce, suppress, or eliminate 'noise' signals, based on the representations.

A trained NMF dictionary as discussed above may be used to generate a decomposed NMF representation of any noisy speech data. The decomposed NMF representation may be used to construct a dynamic mask that, when applied to noisy speech data, removes or otherwise suppresses noise components from the noisy speech data to effectively extract speech components from the noisy speech data. These speech components may then be used as a basis for the generation of enhanced (e.g., speech enhanced) data. This enhanced data may be received by a speaker of an assisted listening device or a hearing aid device, and the speaker may physically reproduce sound associated with the enhanced data (e.g., speech data with little or no noise present). In this way, noise may be removed from noisy speech data (or otherwise suppressed) in real-time and may be played back to a hearing impaired or hard of hearing individual in order to help that individual better perceive speech in noisy environments.

Turning now to FIG. 1, a block diagram of an example system 100, in accordance with aspects of the present disclosure, is shown. The system 100 may be an on-ear module or an in-ear module (e.g., designed to fit on or inside of a person's ear; lightweight with a small form factor) that, when operated, amplifies and/or isolates some or all sound detected in the vicinity of system 100 and replays the amplified and/or isolated sound, for example, in or near the ear of a hearing impaired or hard of hearing individual. In this way, the system 100 may make sounds in the general vicinity of a hearing impaired user more accessible to that user. In general, the system 100 may include a wireless transceiver 102, a microcontroller unit (MCU) 104, a codec 106, an armature receiver 108, one or more microphones 110, a battery and power management module 112, and a memory 114.

The microphone(s) 110 may detect sound in the general vicinity of the system 100. For example, the microphone(s) 110 may detect sounds corresponding to a conversation between a hearing impaired user of the system 100 and one or more other individuals, and may also detect other sounds that are not part of that conversation (e.g., background noise from movement, automobiles, etc.). The microphone(s) 110 may convert the detected sounds into electrical signals to generate sound signals representative of the detected sounds, and these sound signals may be provided to the codec 106.

The codec 106 may include one or more analog-to-digital converters and digital-to-analog converters. The analog-to-digital converters of the codec 106 may operate on the sound signals to convert the sound signals from the analog domain to the digital domain. For example, it may be simpler to perform signal processing (e.g., to implement the speech enhancement processes of FIGS. 3 and 4) on digital signals rather than analog signals.

The digitized sound signals output by the codec 106 may be transferred to the wireless transceiver 102 through the MCU 104. The MCU 104 may be an ultra-low-power controller, which may minimize heat generated by MCU 104 and may extend battery life (e.g., because the MCU 104 would require less power than controllers with higher power consumption).

Figure 2:
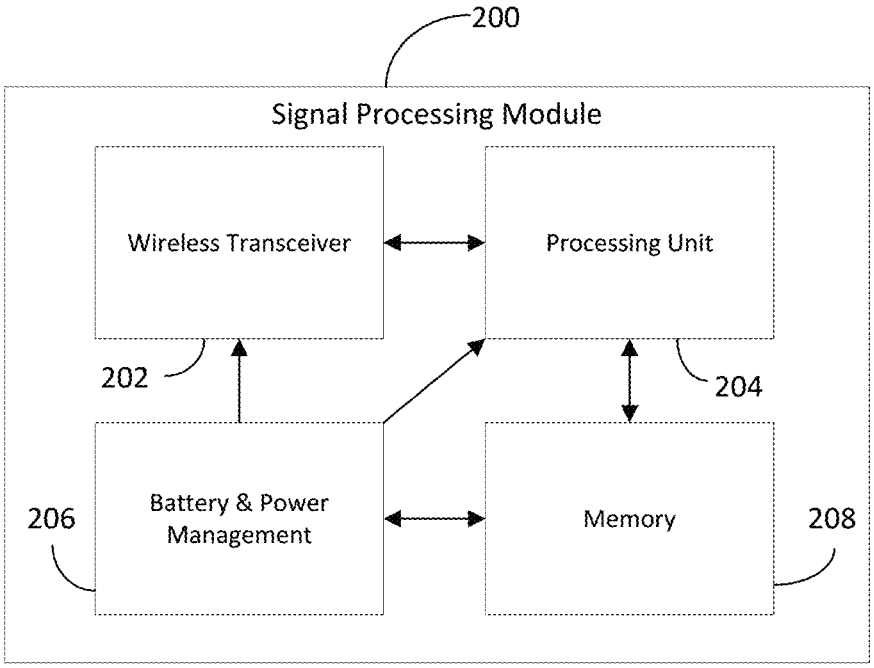
FIG. 2 is a schematic diagram of an illustrative signal processing module, in accordance with aspects of the present disclosure.

The wireless transceiver 102 may be communicatively coupled to a wireless transceiver of an external signal processing module (e.g., the wireless transceiver 202 of the signal processing module 200 of FIG. 2). The digitized sound signals may be transmitted to the wireless transceiver of the external signal processing module using the wireless transceiver 102. For example, the wireless transceiver 102 may transmit the digitized sound signals using a wireless communication method such as radio frequency (RF) amplitude modulation, RF frequency modulation, Bluetooth (IEEE 802.15.1), etc. The wireless transceiver 102 may also receive speech enhanced sound signals (e.g., sound signals on which the speech enhancement processing described below in connection with FIGS. 3 and 4 has been performed) from the wireless transceiver of the external signal processing module using the same wireless communication method.

Speech enhanced sound signals received by the wireless transceiver 102 may be routed to the codec 106, where digital-to-analog converters may convert the speech enhanced sound signals to the analog domain. The analog speech enhanced sound signals may be amplified by an amplifier within the codec 106. The amplified analog speech enhanced sound signals may then be routed to the receiver 108.

The receiver 108 may be a balanced armature receiver or other speaker or receiver and may receive analog speech enhanced sound signals from the codec 106. The analog speech enhanced sound signals cause the receiver 108 to produce sound (e.g., by inducing magnetic flux in the receiver 108 to cause a diaphragm in the armature receiver 108 to move up and down, changing the volume of air enclosed above the diaphragm and thereby creating sound). The sound produced by the receiver 108 may correspond to a speech enhanced version of the sound originally detected by the microphone(s) 110, with reduced noise and enhanced (e.g., amplified) speech components (e.g., corresponding to one or more voices present in the originally detected sound). The amount of time elapsed between the detection of sound by the microphone(s) 110 and the reproduction of corresponding speech enhanced sound at armature receiver 108 may be, for example, less than 10 ms, which may be, for the purposes of the present disclosure, considered real-time speech enhancement. For example, the sound produced by the armature receiver 108 may allow the hearing impaired or hard of hearing user to better hear and understand voices of a conversation in real-time, even in a noisy environment such as a crowded restaurant or a vehicle.

The battery and power management module 112 provides power to various components of system 100 (e.g., the wireless transceiver 102, the MCU 104, the codec 106, the armature receiver 108, the memory 114, and the microphone(s) 110). The battery and power management module 112 may be implemented completely as circuitry in the system 100, or may be implemented partially as circuitry and partially as software (e.g., as instructions stored in a non-volatile portion of the memory 114 and executed by the MCU 104).

The memory 114 may include a non-volatile, non-transitory memory that includes multiple non-volatile memory cells (e.g., read-only memory (ROM), flash memory, non-volatile random access memory (NVRAM), 3D XPoint memory, etc.), and a volatile memory that includes multiple volatile memory cells (e.g., dynamic random access memory (DRAM), static random access memory (SRAM), etc.). The non-volatile, non-transitory memory of the memory 114 may store operating instructions for the system 100 that may be executed by the MCU 104 during operation of the system 100.

Turning now to FIG. 2, a block diagram of an illustrative signal processing module 200 for enhancing speech components of sound signals, in accordance with aspects of the present disclosure, is shown. The signal processing module 200 may, for example, be embedded in a smart phone, a personal computer, a tablet device, or another similar portable digital device, or may be implemented as a stand-alone device that is, for example, capable of being carried in a user's pocket or worn as a wearable device (e.g. smart watch, wristband, smart glasses, necklace, smart headset). The signal processing module 200 may wirelessly communicate with an external system or module capable of detecting sound (e.g., the system 100 of FIG. 1). The signal processing module 200 includes a wireless transceiver 202, a processing unit 204, a battery and power management module 206, and a memory 208.

The wireless transceiver 202 may be communicatively coupled to a wireless transceiver of an external system (e.g., the wireless transceiver 102 of the system 100 of FIG. 1). Digitized sound signals may be transmitted to the wireless transceiver 202 from the wireless transceiver of the external system. For example, the wireless transceiver 202 may receive the digitized sound signals using a wireless communication method such as radio frequency (RF) amplitude modulation, RF frequency modulation, Bluetooth (IEEE 802.15.1), etc. The wireless transceiver 202 may also transmit speech enhanced sound signals produced by processing unit 204 (described below) to the wireless transceiver of the external system using the same wireless communication method.

The processing unit 204 may receive the digitized sound signals from the wireless transceiver 202 and may execute instructions for transforming the digitized sound signals into speech enhanced sound signals (e.g., sound signals on which the speech enhancement processing described below in connection with FIGS. 3 and 4 has been performed). As will be described, the transformation from digitized sound signals into speech enhanced sound signals is performed by removing or suppressing noise in the digitized sound data. The processing unit 204 may be an ultra-low-power microprocessing unit (MPU). By performing digital signal processing at signal processing module 200, rather than at system 100 of FIG. 1, system 100 may no longer need to perform many of the computation-intensive audio signal processing tasks associated with speech enhancement of sound signals, which may result in less heat generation, lower temperatures and longer battery life for system 100 (e.g., compared to if system 100 were to perform these audio signal processing tasks).

The battery and power management module 206 provides power to various components of the signal processing module 200 (e.g., the wireless transceiver 202, the processing unit 204, and the memory 208). The battery and power management module 212 may be implemented completely as circuitry in the system 200, or may be implemented partially as circuitry and partially as software (e.g., as instructions stored in a non-volatile portion of the memory 208 and executed by the processing unit 204).

The memory 208 may include a non-volatile, non-transitory memory that includes multiple non-volatile memory cells (e.g., read-only memory (ROM), flash memory, non-volatile random access memory (NVRAM), 3D XPoint memory, etc.), and a volatile memory that includes multiple volatile memory cells (e.g., dynamic random access memory (DRAM), static random access memory (SRAM), etc.). The non-volatile, non-transitory memory of the memory 208 may store operating instructions for the system 200 that may be executed by the processing unit 204 during operation of the signal processing module 200.

Alternatively, for instances in which the signal processing module 200 is embedded in a digital device such as a smart phone or a tablet device, the signal processing module 200 may receive digitized noisy speech data from processing circuitry (e.g., a CPU) in the digital device, rather than from an external system. This digitized noisy speech data, for example, may by dynamically acquired from the incoming datastream for a video that is being played on the digital device, may be acquired from a voice conversation being conducted between the digital device and another device (e.g., a VoIP or other voice call between two phones; a video call between two tablet devices that is performed using a video communications application, etc.), may be acquired from speech detected by an on-device microphone, or may be acquired from any other applicable source of noisy speech data. For instances in which the digitized noisy speech data is acquired from a voice call, the speech enhancement performed by the signal processing module 200 may be, for example, selectively applied as a preset option for hard of hearing users. For instances in which the digitized noisy speech data is acquired from an incoming datastream for a video, the speech enhancement performed by the signal processing module 200 may be, for example, applied to the sound component of the datastream in order to isolate the speech of the sound component in real-time, and the isolated speech may be played through speaker(s) of the digital device. For instances in which the digitized noisy speech data is acquired from speech detected by an on-device microphone, the speech enhancement performed by the signal processing module 200 may be, for example, applied to the detected speech as a pre-processing step before speech recognition processes are performed on the speech (e.g., such speech recognition processes being performed as part of a real-time captioning function or a voice command interpretation function).

Accordingly, the inventors have recognized that the systems and methods disclosed herein may be adapted for use in mobile hearing assistance devices, telecommunications infrastructure, internet-based communications, voice recognition and interactive voice response systems, for dynamic processing of media (e.g., videos, video games, television, podcasts, voicemail) in real time, and other similar applications, and likewise may find synergy as a pre-processing step to voice recognition and caption generating methods.

Figure 3:
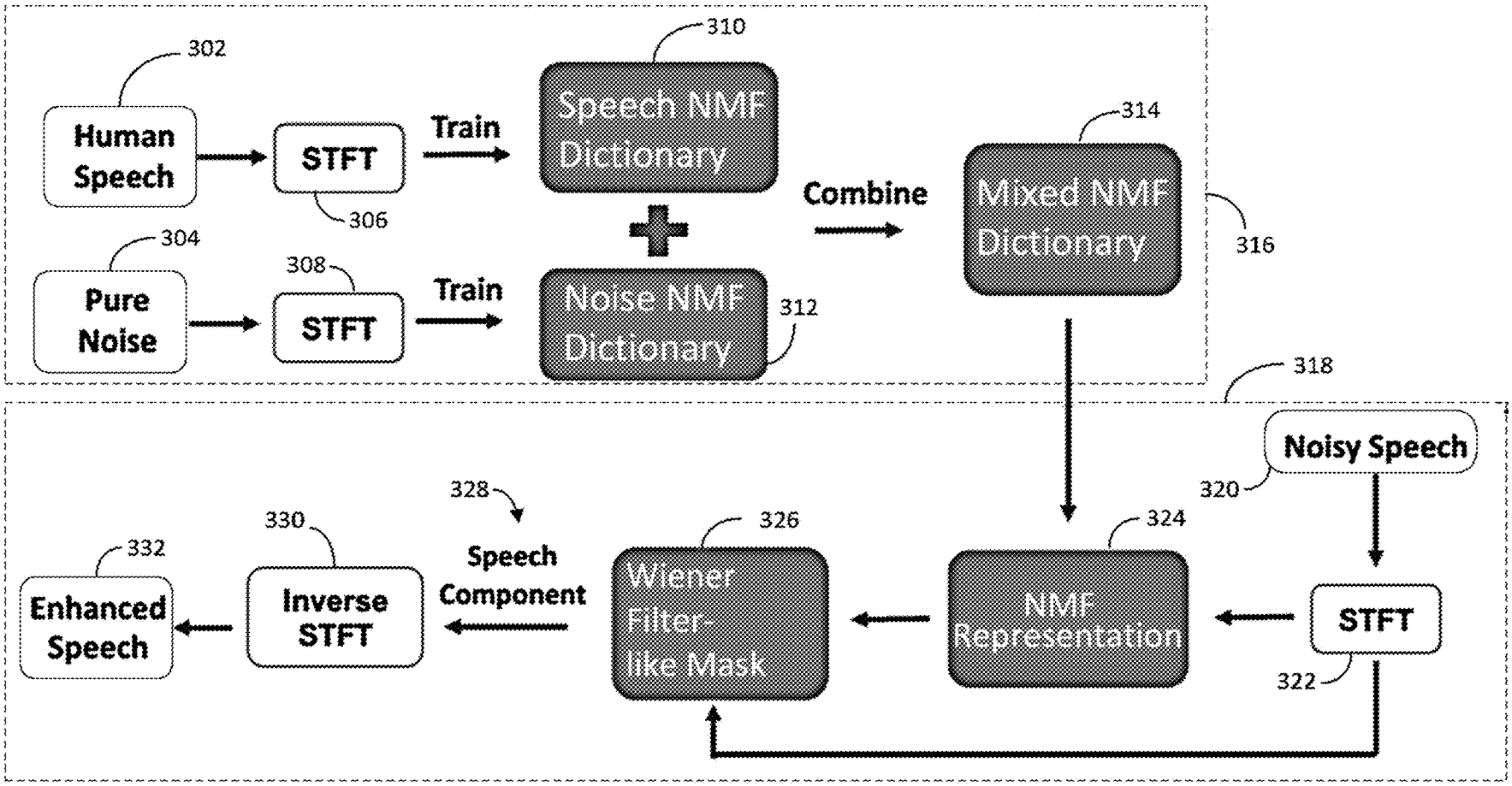
FIG. 3 is an illustration showing a Non-negative Matrix Factorization (NMF) based framework for speech enhancement, in accordance with the present disclosure.

Turning now to FIG. 3, an illustrative flow chart showing a process 316 by which a non-negative matrix factorization (NMF) dictionary is trained and a process 318 by which noisy sound signals are transformed into speech enhanced sound signals, is shown. The process 318 may, for example, be performed by processing hardware such as processing unit 204 in signal processing module 200 or by the MCU 104 of module 100.

The process 316 separately trains a speech NMF dictionary 310 and a noise NMF dictionary 312, which are then combined into a mixed NMF dictionary 314. The training of the speech NMF dictionary in the process 316 may be performed offline, meaning that the mixed NMF dictionary 314 may be created and trained on a separate system (e.g. computer hardware that may include hardware processors and non-volatile memory that are used to perform the process 316 to create the mixed NMF dictionary 314).

The speech NMF dictionary 310, the noise NMF dictionary 312, and the mixed NMF dictionary 314 may be stored in memory (e.g., in memory 208 of signal processing module 200 of FIG. 2), for example, as look-up tables (LUTs) or sets of basis vectors. When the speech NMF dictionary 310 is trained, multiple samples (e.g. digital signals) of noiseless human speech 302 are transformed into the frequency domain using a short-time Fourier transform (STFT) 306. The samples of noiseless human speech 302 may include a variety of different human voices to ensure that the NMF dictionary is not only tuned to a single human voice, and is instead able to identify human speech for many different human voice types including both male and female voice types. These frequency domain human speech samples are then used to "train" or populate the speech NMF dictionary, for example, by creating dictionary entry (e.g., LUT entry or basis vector) for each frequency domain human speech sample. Once trained, the speech NMF dictionary 310 may define multiple ranges of frequencies within which human speech (e.g., across multiple human voices) may occur.

When the noise NMF dictionary 312 is trained, multiple samples (e.g., digital samples) of noise that may occur in a variety of environments (e.g., Gaussian noise, white noise, recorded background noise from a restaurant, etc.) are converted from the time domain to the frequency domain using a STFT 308. These frequency domain noise samples are then used to "train" or populate the noise NMF dictionary, for example, by creating dictionary entry (e.g., LUT entry or basis vector) for each frequency domain noise sample. Once trained, the noise NMF dictionary 312 may define multiple ranges of frequencies within which noises in a variety of environments may occur.

A mixed NMF dictionary is then generated by concatenating the speech NMF dictionary 310 and the noise NMF dictionary 312 together. As such, the mixed NMF dictionary not only stores human speech models across multiple human voices but also stores noise models across a variety of environments.

Once the mixed NMF dictionary 314 is trained using the process 316, the process 318 may be performed (e.g., by the processing unit 204 of the signal processing module 200 of FIG. 2). The process 318 transforms noisy speech data 320 from the time domain to the frequency domain using STFT 322. The noisy speech data 320 may, for example, be a bitstream segmented into small frames. The noisy speech data 320 may be processed frame-by-frame, with each frame, for example, including 100 audio sample points in order to achieve real-time (the amount of time elapsed between the detection of sound by the microphone(s) 110 and the reproduction of corresponding speech enhanced sound may be less than 10 ms) speech enhancement (e.g., compared to frames with a larger number of audio sample points). An NMF representation 324 of the frequency domain representation of the noisy speech data 320 is then generated based on the mixed NMF dictionary 314.

A Wiener Filter-like mask 326 may then be used to remove or suppress some or all of the noise components of the frequency domain representation of the noisy speech data 320 using the NMF representation 324. The Wiener Filter-like mask 326 is referred to here as being like a Wiener Filter because the Wiener Filter may traditionally be considered a static filter, whereas the present Wiener Filter-like mask 326 is dynamic (e.g., its characteristics change based on the NMF representation 324). While a Wiener Filter-like mask is used in the present embodiment, it should be readily understood that any desired dynamic filter may be used in place of Wiener Filter-like mask 326.

A Wiener Filter-like Mask as disclosed herein can be represented as N-dimensional vector $W \in R^N$. If it is binary mask, then the elements in $W \in R^N$ are either 0 or 1. If it is a soft mask, then the elements w in $W \in R^N$ are in the range of 0.0 to 1.0. Therefore, assuming a Wiener Filter-like Mask W is obtained, and the noisy speech audio in frequency domain is X, then the denoised speech audio in the frequency domain can be computed as $\tilde{X} = X \odot W$, where $\odot$ is the element-wise matrix multiplication operation.

The Wiener Filter-like mask 326 produces a speech component 328 at its output. The speech component 328 is a frequency domain representation of the noisy speech data 320 from which most or substantially all noise has been removed or suppressed. The speech component 328 is then transformed from the frequency domain to the time domain by an inverse STFT 330 to produce enhanced speech data 332. The enhanced speech data 332 may then be provided to a speaker (e.g., armature receiver 108 of FIG. 1 or the speaker of any other desired assisted listening device) at which the enhanced speech data 332 is physically reproduced as sound.

Figure 4:
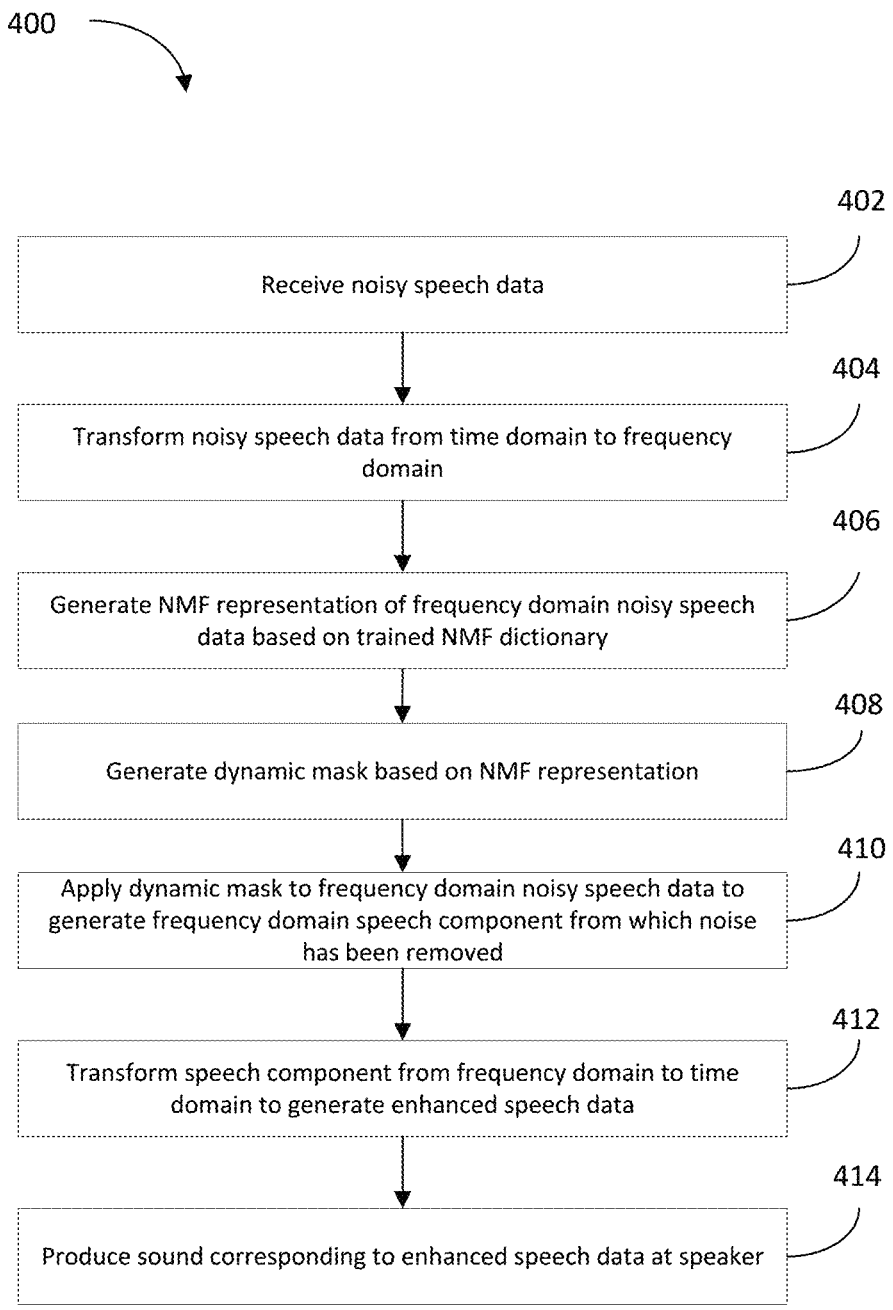
FIG. 4 is a process flow chart illustrating a process by which speech enhancement may be implemented, in accordance with aspects of the present disclosure.

FIG. 4 illustrates a method 400 by which noisy speech data (e.g., noisy speech data 320 of FIG. 3) may be transformed into enhanced speech data (e.g., enhanced speech data 332 of FIG. 3) from which noise has been removed or suppressed using a trained NMF dictionary.

At 402, a processor (e.g., processing unit 204 of FIG. 2) receives noisy speech data (e.g., noisy speech data 320 of FIG. 3) in the time domain. The noisy speech data may be a frame of a noisy speech bitstream, where the frame represents a predetermined number of audio samples (e.g., of sound of a conversation in a noisy environment) captured by a microphone (e.g., microphone(s) 110 of FIG. 1).

At 404, the processor transforms the noisy speech data from the time domain to the frequency domain. For example, the processor may use a STFT (e.g., STFT 322 of FIG. 3) to transform the noisy speech data from the time domain to the frequency domain.

At 406, the processor generates an NMF representation (e.g., NMF representation 324 of FIG. 3) of the frequency domain noisy speech data using an NMF dictionary (e.g., mixed NMF dictionary 314) that has been trained to define frequency ranges associated with speech and frequency ranges associated with noise. The NMF representation 324 is the concatenation of the NMF representation of the human speech component in the noisy speech and the NMF representation of the background noise component in the noisy speech.

At 408, a dynamic mask is generated based on the NFM representation. For example, the dynamic mask may be a Wiener Filter-like mask (e.g., Wiener Filter-like mask 326 of FIG. 3), or any other desired dynamic mask. One example of the Wiener Filter-like mask 326 is the binary mask where the values of the mask are either 0 or 1. In this case, the overlap between the human speech component and the background noise component are either completely removed (mask value equal to 0) or completely maintained (mask value equal to 1). Another example of the Wiener Filter-like mask 326 is the soft mask where the values of the mask are continuous between 0 and 1. In this case, the overlap between the human speech component and the background noise component are proportionally removed or suppressed.

For example, Wiener Filter-like mask 326 may be implemented using a filter bank that includes an array of filters (e.g., which may mimic a set of parallel bandpass filters, or other filter types) that separates frequency domain noisy speech data 320 into a plurality of frequency band components, each corresponding to a different frequency band. Each of these frequency band components may then be multiplied by a 0 or a 1 (or, for instances in which Wiener Filter-like mask 326 is a soft mask, may be multiplied by a number ranging from 0 to 1 that corresponds to a ratio between speech and noise associated with the respective frequency band for a given frequency band component) in order to preserve frequency band components associated with speech while removing or suppressing frequency band components associated with noise. For example, for instances in which Wiener Filter-like mask 326 is a binary mask, a frequency band component that is identified as being associated with noise may be multiplied by 0 when the mask is applied, a frequency band component that is identified as being associated with speech may be multiplied by 1 when the mask is applied. In this way, frequency band components containing speech may be preserved while frequency band components containing noise may be removed.

As another example, for instances in which Wiener Filter-like mask 326 is a soft mask, a frequency band component that is identified as being made up of 40% speech and 60% noise may be multiplied by 0.4 when the mask is applied. In this way, frequency band components associated with both speech and noise may be proportionally removed or suppressed. Such a frequency band component that is associated with both noise and speech may be identified when, for example, bystander voices make up part of the noisy speech data.

In some embodiments, the user may have the ability to select the degree to which the systems and methods disclosed herein (e.g., utilizing a filter-based approach, such as described above) remove or suppress background noise. For example, a user that has very limited hearing may wish to amplify the speech component of the incoming audio signal (whether that is ambient noise being picked up by a microphone or directional microphone, or an incoming digital or analog audio signal) and remove all other sounds. Another user may wish to simply remove the "din" of background conversation by applying user settings that cause the filter-like mask 326 to suppress or remove only certain categories of identified background noise. Another user may have difficulty hearing only certain frequency ranges, and so the filter-like mask 326 can be adapted to match the user's audiogram of hearing capability/loss. In other words, only speech of interest falling within certain amplitudes or frequency ranges would be improved for the user (either by amplification or by removing other unwanted sounds/noise in those frequency ranges). For example, a user may be wearing an in-ear module which produces improved sound, and may utilize their phone or other mobile device (e.g., via an app) to dynamically adjust the type and degree of hearing assistance being provided by the in-ear module. Another user may only wish to remove background noise that reaches a certain peak or intermittent volume (e.g., intermittent peak noises from aircraft engines or construction sites).

At 410, the dynamic mask is multiplied to the frequency domain noisy speech data in order to generate a frequency domain speech component (e.g., speech component 328) from which noise has been removed or suppressed.

At 412, the speech component is transformed from the frequency domain to the time domain to generate enhanced speech data. For example, an inverse STFT (e.g., inverse STFT 330 of FIG. 3) may be applied to the speech component in order to transform the speech component from the frequency domain to the time domain.

At 414, a speaker may produce sound corresponding to the enhanced speech data. For example, the enhanced speech data may be transferred (through a wired or wireless connection) from a signal processing module (e.g., the signal processing module 200 of FIG. 2) to an assistive listening device or hearing aid device (e.g., system 100 of FIG. 1). A speaker (e.g., the armature receiver 108 of FIG. 1) in the assisted listening or hearing aid device may then reproduce physical sound from the enhanced speech data corresponding to the enhanced speech represented in the enhanced speech data. In some instances the enhanced speech data may be amplified (e.g., at the codec 106 of FIG. 1) before being reproduced at the speaker.

It should be noted that process 400 may be performed continuously in order to perform frame-by-frame processing of a noisy speech bitstream to produce enhanced speech data and corresponding sounds in real time.

In one aspect of the systems and methods disclosed here, a processing unit (e.g., processing unit 204 of FIG. 2) executes a program comprising instructions stored on a memory, that cause the processing unit to utilize the aforementioned NMF techniques to process an input audio stream and output in real time a modified audio stream that focuses on or highlights only a category of types of sounds, such as the voice or voices of people with whom a user may be conversing. Doing so allows users who hear the modified audio stream to more easily focus a person speaking to them. For example, some children with various forms of autism spectrum disorder are particularly sensitive to certain sounds—those sounds could be learned for a given user and suppressed. Conversely, some children or adults may have difficulty in determining which sounds they should be focusing their attention on—for such use cases the systems and methods disclosed herein could be attuned to help those users focus on individuals speaking to them. For example, in embodiments in which a smartphone is coupled to an earpiece that implements the techniques disclosed herein, a geofencing system can be implemented that detects when a student enters a classroom, and automatically (or on demand) deploys a particular set of filters and algorithms (as disclosed above) for focusing on the particular voice of the student's teacher (or focuses on any sound input recognized as human voice, from a directional microphone pointed toward the front of the classroom).

In another embodiment, a device of the present disclosure could detect that a user is operating a loud vehicle (e.g., such as heavy construction equipment), for example by initiating a Bluetooth connection with the vehicle. In such situations, the device's processor could then adjust a filter mask that is tailored to the sounds typically experienced when operating the vehicle. In such an instance, the device may modify audio output of a set of wireless earbuds of the operator, to suppress sounds recognized as background noise (e.g., engine noise) and/or highlight other surrounding noises (such as warning sounds, alerts like horns or sirens from other vehicles, human voices, or the like). Such a device could also be integrated within the onboard system of the vehicle, rather than being on a mobile device of the user, relying on external (to the cabin) microphones for audio input and using internal cabin speakers to reproduce modified audio for the user.

In another embodiment, a device of the present disclosure could be integrated into hearing protection gear worn by individuals working in loud environments. In such cases, the hearing protection gear's inherent muffling or reduction of sound could be coupled with a further suppression of background noise by the systems and methods disclosed herein, to allow an individual on a loud job site to hear voices yet not risk hearing loss due to loud ambient noise. For example, individuals working in construction, mining, foundries, or other loud factory settings could wear a hearing protection device (HPD) such as a set of earmuffs, into which a processor, memory, microphone(s), and speakers (such as disclosed with respect to FIG. 2) are integrated.

One useful aspect of the systems and methods disclosed herein is that all components involved in providing a focused or modified audio output to a user can be integrated into a single, lightweight, compact, (and thus resource-limited) device such as a hearing aid or headphones. Thus, such a system provides realtime audio processing to highlight human speech, while avoiding the problem of a user having to wear multiple devices (e.g., a headphone may stops working if a user walks away from an associated laptop computer connected by Bluetooth).

Likewise, another helpful aspect of the systems disclosed herein is that by integrated a processor, memory, microphone, and speaker into a single device, a more "real-time" experience can be provided. While a processor could be located external to an in-ear device (e.g., a hearing aid connected to a mobile phone), doing so would introduce latency because of the dual signals needing to be transmitted between the two devices: the in-ear device would be transmitting an audio signal received from a microphone to the external processor, and the external processor would then transmit a modified audio signal back to the in-ear device for reproduction to the user. Onboarding the processing unit into the in-ear device (such as a hearing aid or earmuffs) eliminates these sources of potential latency or device failure.

In another implementation of the systems and methods disclosed herein, the dictionaries described above may be implemented in a way that makes they adaptive to new inputs and user feedback during operation. For example, in one embodiment an application stored on memory of a mobile device may be running on a processor (such as the onboard processor of a mobile phone) and monitoring which categories of sounds are being identified as background noise and suppressed. The techniques described above for identifying background noise could be performed via software on the mobile device or onboard an earpiece that provides monitoring data to the mobile device processor through a suitable communication (e.g., a limited access WiFi, Bluetooth, or other connection). If a user finds that the device is mis-identifying a new noise as background (when it should be identified as speech of interest) or mis-identifying a background noise as speech of interest, a user could signal to the software running on the mobile device that the speech enhancement software has mis-identified a new sound. This could be done through a user interface of the mobile phone, or the mobile phone could automatically determine a mis-identification through user cues (such as, e.g., the user saying "What?" or "Pardon me?" in response to a new sound picked up by a microphone of the earpiece; or by other implicit user cues such as the user turning up or turning down the volume of the earpiece in response to a new noise). In an implementation in which a user actively signals a mis-identification of a new sound via a user interface, the user could toggle a button or switch on the screen of the mobile device to signal to the mobile device that it should change its treatment (e.g., suppression, increasing volume, etc.) of a new sound. Once the user is satisfied with the sound output, the processor of the mobile device could use the user's feedback to characterize the new sound as "background" or "speech of interest" and add the sound to the dictionaries implementing the speech enhancement software accordingly. The software operating on either the mobile device or earpiece could then be adaptively updated.

In some embodiments, users could opt to share their adaptive assessments of new noises with other users to be added to their dictionaries. For example, in a loud work environment, if a new piece of heavy equipment arrives that a first user identifies to his or her device as "background noise," that identification could be pushed via a WiFi or other suitable network to the dictionaries of co-workers at the same site, or to a larger network of users.

In further embodiments, a location service of a user's mobile device could be used to adaptively select from a set of filters or dictionaries that are tailored to the physical location of a user. For example, when a user is at home, a device might utilize a set of filters and dictionaries that suppress less background noise (maybe only a dishwasher and air conditioner humming), but when a user is at work the device may load and begin using a set of filters and dictionaries that suppress more types of background noise (e.g., the noise of cars if a person works near a busy street, or the noise of mechanical equipment in a factory). Likewise, a user's mobile device may employ predetermined or learned voice signatures to identify specific speakers who frequently talk to a user. When a speaker is identified, the user's mobile device may dynamically react by suppressing certain background noises or frequencies that enable the user to better hear that specific speaker's voice. In this manner, the systems and methods herein may be factorized, so that devices in accordance with this disclosure can adapt themselves to use the most appropriate amount of onboard processing resources to provide the most appropriate levels of sound enhancement for a given setting.

The present invention has been described in terms of one or more preferred embodiments, and it should be appreciated that many equivalents, alternatives, variations, and modifications, aside from those expressly stated, are possible and within the scope of the invention.

The invention claimed is:

1. A method comprising:

with a processor, receiving noisy speech data;

with the processor, using a trained mixed non-negative matrix factorization (NMF) dictionary that comprises a trained noise NMF dictionary and a trained speech NMF dictionary to remove noise components from the noisy speech data to produce enhanced speech data, the trained noise NMF dictionary being trained with noise samples; and with the processor, instructing communications circuitry to send the enhanced speech data to at least one of: a speaker configured to produce sound corresponding to the enhanced speech data, and a speech processing software application.

2. The method of claim 1, wherein using the trained mixed NMF dictionary to remove the noise components from the noisy speech data to produce the enhanced speech data comprises:

with the processor, generating a NMF representation of the noisy speech data using the trained mixed NMF dictionary; and with the processor, applying a mask to the noisy speech data to remove the noise components from the noisy speech data to produce at least one speech component of the noisy speech data.

3. The method of claim 2, wherein using the trained mixed NMF to remove the noise components from the noisy speech data to produce the enhanced speech data further comprises:

with the processor, generating the mask based on the NMF representation.

4. The method of claim 3, wherein using the trained mixed NMF dictionary to remove the noise components from the noisy speech data to produce the enhanced speech data further comprises:

with the processor, performing a first domain transform on the noisy speech data to transform the noisy speech data from a time domain to a frequency domain; and with the processor, performing a second domain transform on the at least one speech component to transform the at least one speech component from the frequency domain to the time domain to produce the enhanced speech data.

5. The method of claim 1, wherein the noisy speech data is generated by a microphone of an external device.

6. The method of claim 5, wherein the speaker is part of the external device, wherein the external device is selected from the group consisting of an assistive listening device and a hearing aid.

7. The method of claim 6, wherein instructing communications circuitry to send the enhanced speech data to a speaker comprises:

with the processor, instructing a first transceiver of the communications circuitry to wirelessly transmit the enhanced speech data to a second transceiver of the external device.

8. A system comprising:

an audio signal input device coupled to a signal processing module to communicate noisy speech data to the signal processing module; and the signal processing module comprising a processing unit and a memory, the memory having a set of instructions stored thereon which, when executed by the processing unit, cause the signal processing module to:

receive the noisy speech data from the audio signal input device;

transform the noisy speech data into enhanced speech data by suppressing noise from the noisy speech data using a trained mixed non-negative matrix factorization (NMF) dictionary that comprises a trained noise NMF dictionary and a trained speech NMF dictionary, the trained noise NMF dictionary being trained with noise samples; and transmit the enhanced speech data to an audio output module.

9. The system of claim 8, wherein the audio output module comprises:

the audio signal input device, which comprises at least one microphone; and a transceiver configured to transmit the noisy speech data to the signal processing module, and to receive the enhanced speech data.

10. The system of claim 9, wherein, when executed by the processing unit, the set of instructions further cause the signal processing module to:

generate a NMF representation of the noisy speech data using the trained NMF dictionary.

11. The system of claim 10, wherein, when executed by the processing unit, the set of instructions further cause the signal processing module to:

generate a mask based on the NMF representation; and apply the mask to the noisy speech data to suppress the noise from the noisy speech data to produce a speech component.

12. The system of claim 11, wherein the mask is a soft mask, and wherein to apply the mask, the signal processing module uses a filter bank to separate the noisy speech data into a plurality of frequency band components, and then multiplies each of the plurality of frequency band components by a respective value of an array of values between 0 and 1, wherein a given value of the array of values by which a given frequency band component of the plurality of frequency band components is multiplied is determined based on a ratio of noise to speech for the given frequency band component.

13. The system of claim 11, wherein, when executed by the processing unit, the set of instructions further cause the signal processing module to:

apply a Fourier transform to the noisy speech data to transform the noisy speech data from a time domain to a frequency domain; and to apply an inverse Fourier transform to the speech component to transform the speech component from the frequency domain to the time domain to produce the enhanced speech data.

14. The system of claim 9, wherein the audio output module further comprises:

an output device coupled to the transceiver;

an additional processing unit coupled to the output device; and an additional memory having an additional set of instructions stored therein which, when executed by the additional processing unit, cause the output device to receive the enhanced speech data and produce audible sound based on the enhanced speech data.

15. A signal processing module comprising:

communications circuitry configured to receive noisy speech data from an external device; and a processing unit configured to use a trained mixed non-negative matrix factorization (NMF) dictionary that combines a trained noise NMF dictionary with a trained speech NMF dictionary to remove noise from the noisy speech data to produce enhanced speech data, wherein the communications circuitry is further configured to transmit the enhanced speech data to the external device.

16. The signal processing module of claim 15, wherein the processing unit is further configured to generate a NMF representation of the noisy speech data using the trained NMF dictionary.

17. The signal processing module of claim 16 wherein the processing unit is further configured to generate a mask based on the NMF representation and to apply the mask to the noisy speech data to remove the noise from the noisy speech data to produce a speech component.

18. The signal processing module of claim 17, wherein the processing unit is further configured to transform the noisy speech data from a time domain to a frequency domain, and transform to the speech component from the frequency domain to the time domain to produce the enhanced speech data.

19. The signal processing module of claim 15, wherein the processing unit comprises a microprocessor unit, and wherein the communications circuitry comprises a wireless transceiver configured to wirelessly communicate with the external device.

20. The signal processing module of claim 15, wherein the processing unit is configured to produce the enhanced speech data from the noisy speech data in less than 10 milliseconds.

21. A method comprising steps of:

generating, by a first processor, a trained speech non-negative matrix factorization (NMF) dictionary by:

receiving a set of training speech samples corresponding to human speech;

training a speech NMF dictionary by creating dictionary entries based on the set of training speech samples to produce a trained speech NMF dictionary;

generating, by the first processor, a trained noise NMF dictionary by:

receiving noise samples corresponding to noise;

training a noise NMF dictionary by creating dictionary entries based on the noise samples to produce a trained noise NMF dictionary; and combining, by the first processor, the trained speech NMF dictionary with the trained noise NMF dictionary to generate a trained mixed NMF dictionary.

22. The method of claim 21, further comprising steps of:

storing, by the first processor upon generating the trained mixed NMF dictionary, the trained mixed NMF dictionary on a memory device.

23. The method of claim 21, further comprising steps of:

receiving, by a second processor coupled to a memory device, noisy speech data; and generating, by the second processor upon receiving the noisy speech data, enhanced speech data from the noisy speech data based on the trained mixed NMF dictionary.

24. The method of claim 23, wherein generating the enhanced speech data comprises:

generating, by the second processor, a NMF representation of the noisy speech data using the trained mixed NMF dictionary; and applying, by the second processor, a mask to the noisy speech data to remove noise components from the noisy speech data to produce at least one speech component of the noisy speech data.

25. The method of claim 24, wherein generating the enhanced speech data further comprises:

generating, by the second processor, the mask based on the NMF representation.

26. The method of claim 25, wherein generating the enhanced speech data further comprises:

performing, by the second processor, a first domain transform on the noisy speech data to transform the noisy speech data from a time domain to a frequency domain; and performing, by the second processor, a second domain transform on the at least one speech component to transform the at least one speech component from the frequency domain to the time domain to produce the enhanced speech data.

* * * * *